US006790151B2

(12) United States Patent
Wilson et al.

(10) Patent No.: US 6,790,151 B2
(45) Date of Patent: Sep. 14, 2004

(54) PORTABLE ADJUSTABLE BASKETBALL HOOP APPARATUS

(76) Inventors: LaRhonda L. Wilson, 2201 E. 97th St., Cleveland, OH (US) 44106; Jacinta M. Wilson, 2201 E. 97th St., Cleveland, OH (US) 44106

( * ) Notice: Subject to any disclaimer, the term of this patent is extended or adjusted under 35 U.S.C. 154(b) by 0 days.

(21) Appl. No.: 10/287,888

(22) Filed: Nov. 5, 2002

(65) Prior Publication Data

US 2004/0087393 A1 May 6, 2004

(51) Int. Cl.[7] ..... A63B 63/08
(52) U.S. Cl. ..... 473/483; 473/479; 473/485
(58) Field of Search ..... 473/483, 484, 473/479, 485, 476, 481, FOR 100; D20/41; 40/607.13, 607.14

(56) References Cited

U.S. PATENT DOCUMENTS 2,942,366 A * 6/1960 Pfaff, Jr. et al. ..... 40/624
3,776,549 A * 12/1973 Ganis ..... 473/483
4,005,860 A 2/1977 Ebstein et al.
4,941,661 A 7/1990 Lykens
4,946,163 A 8/1990 Aakre et al.
4,974,841 A * 12/1990 Jarriel et al. ..... 473/483
5,158,281 A 10/1992 Williams
5,470,054 A * 11/1995 Bohrman ..... 473/481
5,570,879 A 11/1996 Glancey et al.
5,570,880 A * 11/1996 Nordgran ..... 473/481
5,813,929 A * 9/1998 Tobin ..... 473/485
5,980,401 A * 11/1999 Erlewine ..... 473/481
6,273,834 B1 * 8/2001 Winter ..... 473/484

* cited by examiner

*Primary Examiner*—Stephen P. Garbe
*Assistant Examiner*—M. Chambers
(74) *Attorney, Agent, or Firm*—Dale J. Ream

(57) ABSTRACT

A portable and adjustable basketball hoop apparatus includes a backboard with a hoop connected to a front thereof. An elongate clamping arm is pivotally coupled to a back of the backboard for pivoting between clamped and released configurations. A rear support member of the clamping arm and the back of the backboard are capable of sandwiching an upstanding structure therebetween in the clamped configuration. A lower end of the clamping arm may be releasably coupled to the upstanding structure with a ratcheted strap assembly whereby to secure the backboard thereto in the clamped configuration. The clamping arm may be released from the upstanding structure in the released configuration whereby to adjust the backboard longitudinally along the upstanding structure.

14 Claims, 5 Drawing Sheets

PORTABLE ADJUSTABLE BASKETBALL HOOP APPARATUS

BACKGROUND OF THE INVENTION

This invention relates generally to basketball hoop assemblies and, more particularly, to a hoop apparatus that may be mounted to virtually any upstanding structure of radius and that may be vertically adjusted thereon once mounted.

Height-adjustable basketball goal assemblies are common and popular for use on the driveway of a residence or at a gymnasium facility. While some such devices include wheels for some degree of mobility, the existing devices typically include a pole or other bulky framework that is not easily portable. On the other hand, basketball goals that are not connected to a framework or pole typically must be permanently attached to a selected structure and do not provide easy height adjustment without using a ladder.

Therefore, it is desirable to have basketball hoop apparatus in which a backboard may be easily clamped to or released from a selected upstanding structure. Further, it is desirable to have a basketball hoop apparatus that may be vertically adjusted along the upstanding structure. In addition, it is desirable to have a basketball hoop apparatus that is portable in that it does not include an integrated pole or support structure.

SUMMARY OF THE INVENTION

A portable and adjustable basketball hoop apparatus according to the present invention includes a backboard with a rim attached to a front thereof. The apparatus further includes an elongate clamping arm pivotally coupled to a back of the backboard and is pivotal between clamped and released configurations. The backboard and clamping arm may be positioned so as to sandwich an upstanding structure therebetween, such as a utility pole, porch post, or small tree. In the clamped configuration, the clamping arm is pivoted to a downward position such that a rear support member of the clamping arm is pressed firmly against a back of the upstanding structure and the backboard is pressed firmly against a front of the upstanding structure. The clamping arm may be secured to the upstanding structure with a strap attachment so as to hold the backboard in this clamped configuration. When the strap attachment is loosened and the clamping arm is pivoted upwardly, the backboard may be vertically moved along the upstanding structure to a desired position thereon. Or, the clamping arm may be completely detached from the backboard so that the apparatus may be transported easily to another location.

Therefore, a general object of this invention is to provide a basketball hoop apparatus that may be mounted to any upstanding structure having a suitable radius.

Another object of this invention is to provide a basketball hoop apparatus, as aforesaid, which may be easily positioned longitudinally along the upstanding structure by a person standing on the ground.

Still another object of this invention is to provide a basketball hoop apparatus, as aforesaid, that may be easily removed from an upstanding structure and transported to another desired location.

Yet another object of this invention is to provide a basketball hoop apparatus, as aforesaid, having padded clamping members that do not damage an upstanding structure when the apparatus is clamped thereto.

A further object of this invention is to provide a basketball hoop apparatus, as aforesaid, that is lightweight and easy to manufacture.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
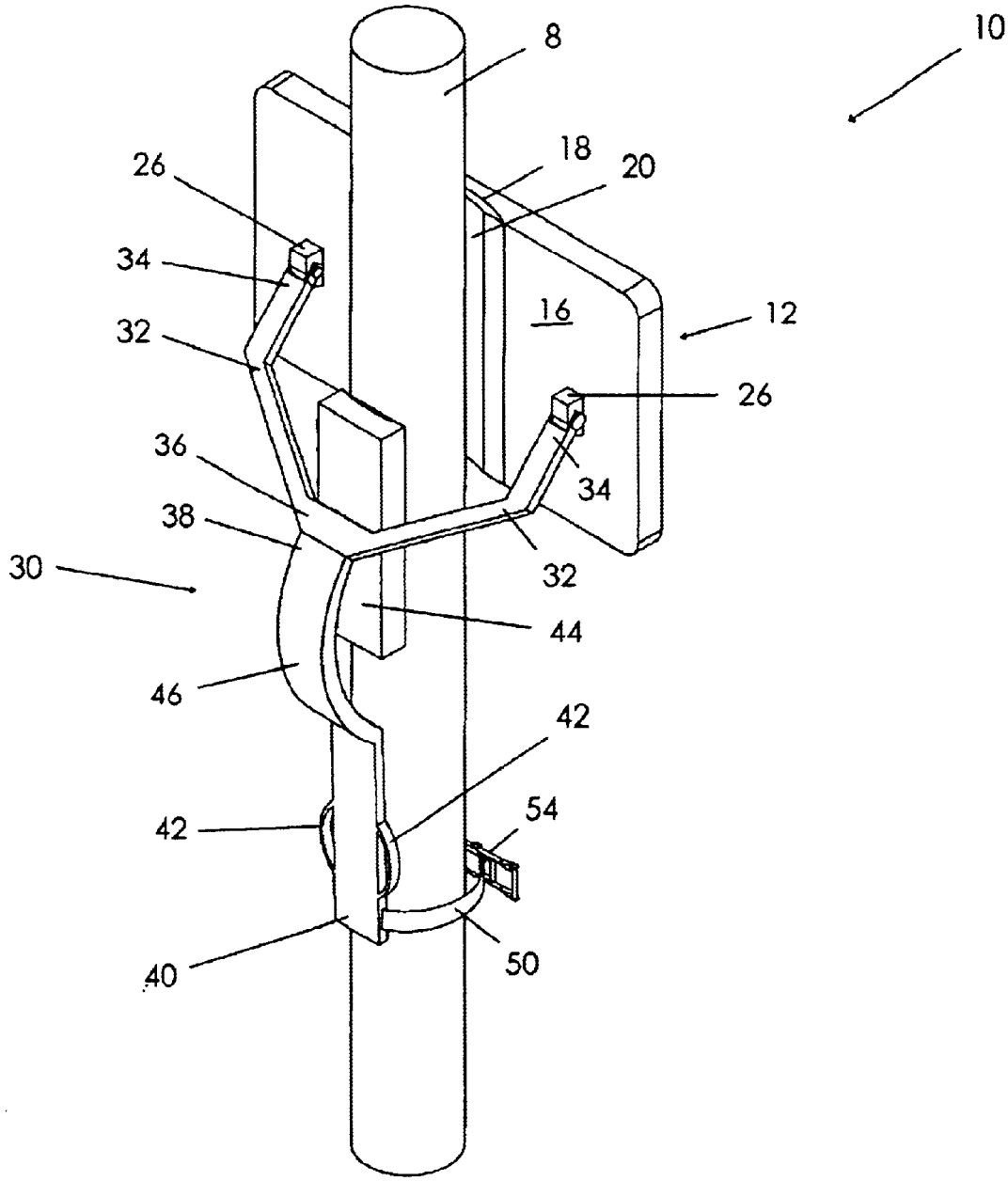
FIG. 1 is a rear perspective view of a basketball hoop apparatus according to one embodiment of the present invention mounted upon an upstanding structure of radius.

A portable and adjustable basketball hoop apparatus according to the present invention will now be described in detail with reference to FIGS. 1 through 5 of the accompanying drawings. A hoop apparatus 10 according to one embodiment of the present invention is shown particularly in FIGS. 1 through 4 and includes a backboard 12 having a front 14 and a back 16. A conventional basketball rim 22 is mounted to the front 14 of the backboard 12 and extends generally perpendicular to the front 14 (FIG. 2). A net 24 may be coupled to the rim 22. The backboard 12 includes top and bottom edges with side walls extending therebetween in a conventional construction. A pair of mounting brackets 26 are fixedly attached to the back 16 of the backboard 12.

Figure 2:
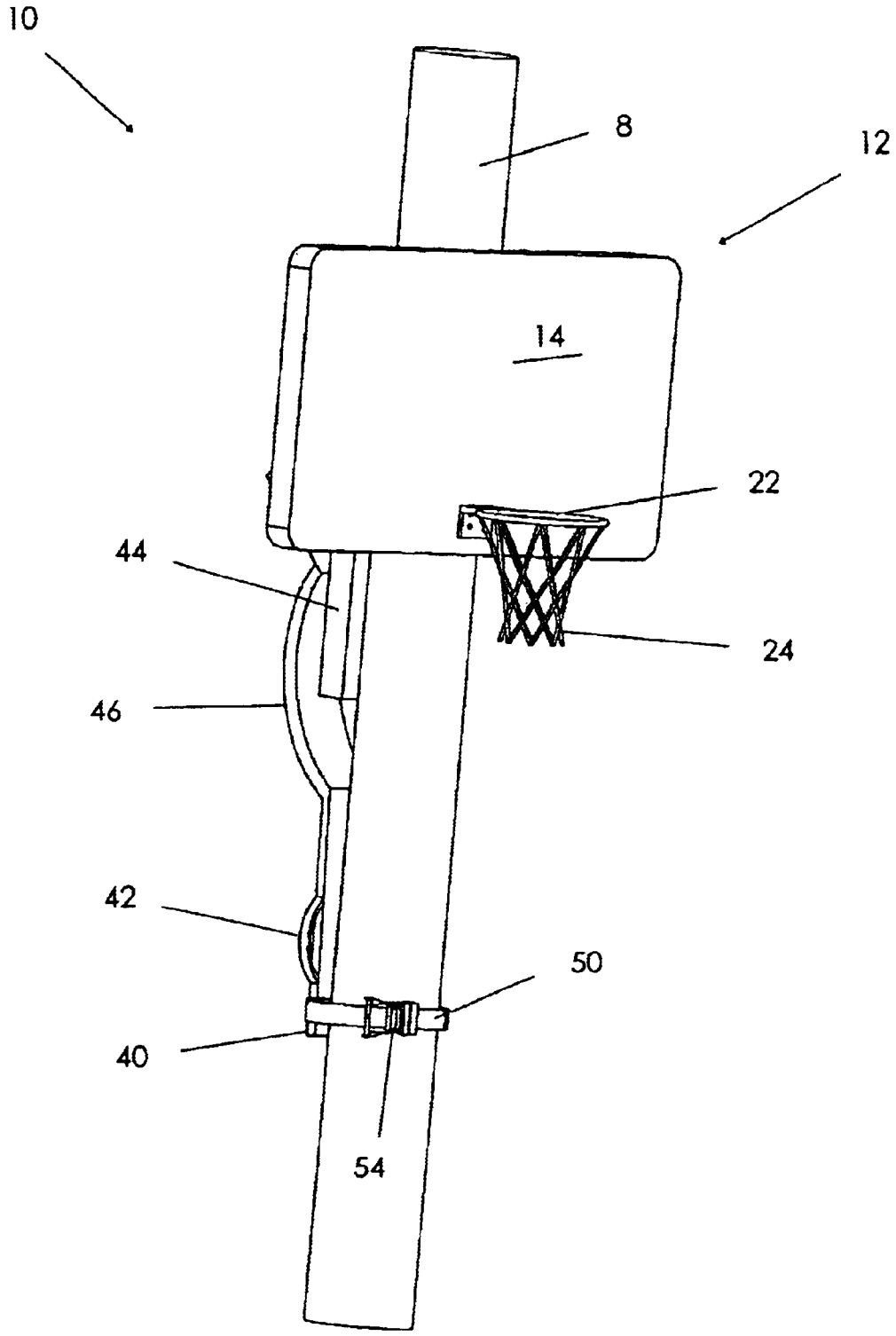
FIG. 2 is a front perspective view of the apparatus as in FIG. 1.

Departing from a conventional construction, however, the back 16 of the backboard 12 defines a recess 18 that extends between the top and bottom edges and is positioned midway between the side walls (FIG. 1). The recess 18 presents a concave configuration that is substantially complementary to upstanding structures of radius, such a utility poles, small trees, and the like so as to snuggly nest therewith in use, as to be described in more detail later. A layer of padded material 20, such as rubber, may be affixed to the backboard 12 within the recess 18 so as to prevent damage to the backboard 12 or structure and to provide a gripping surface.

The hoop apparatus 10 includes a clamping assembly coupled to the back 16 of the backboard 12 for selectively mounting the apparatus to an upstanding structure 8 (FIG. 1). More particularly, the clamping assembly includes a clamping arm 30 having an upper portion, the upper portion including a pair of divergent support braces 32 and a lower end 36. Each support brace 32 includes a free end 34 that may be pivotally coupled to a respective bracket 26 on the back 16 of the backboard 12. Preferably, this pivotal coupling is with pins such that the support braces 32 may be easily and quickly attached to or detached from the backboard 12. The clamping arm 30 further includes a lower portion having an upper end 38 fixedly attached to the lower end 36 of the upper portion. The lower portion also includes a lower free end 40. A pair of handles 42 are fixedly attached to the lower portion of the clamping arm 30 adjacent the lower free end 40 thereof although a single handle would also work. These handles 42 enable a user to grasp the clamping arm 30 and move it between clamped and released configurations, as to be further described below.

Figure 3:
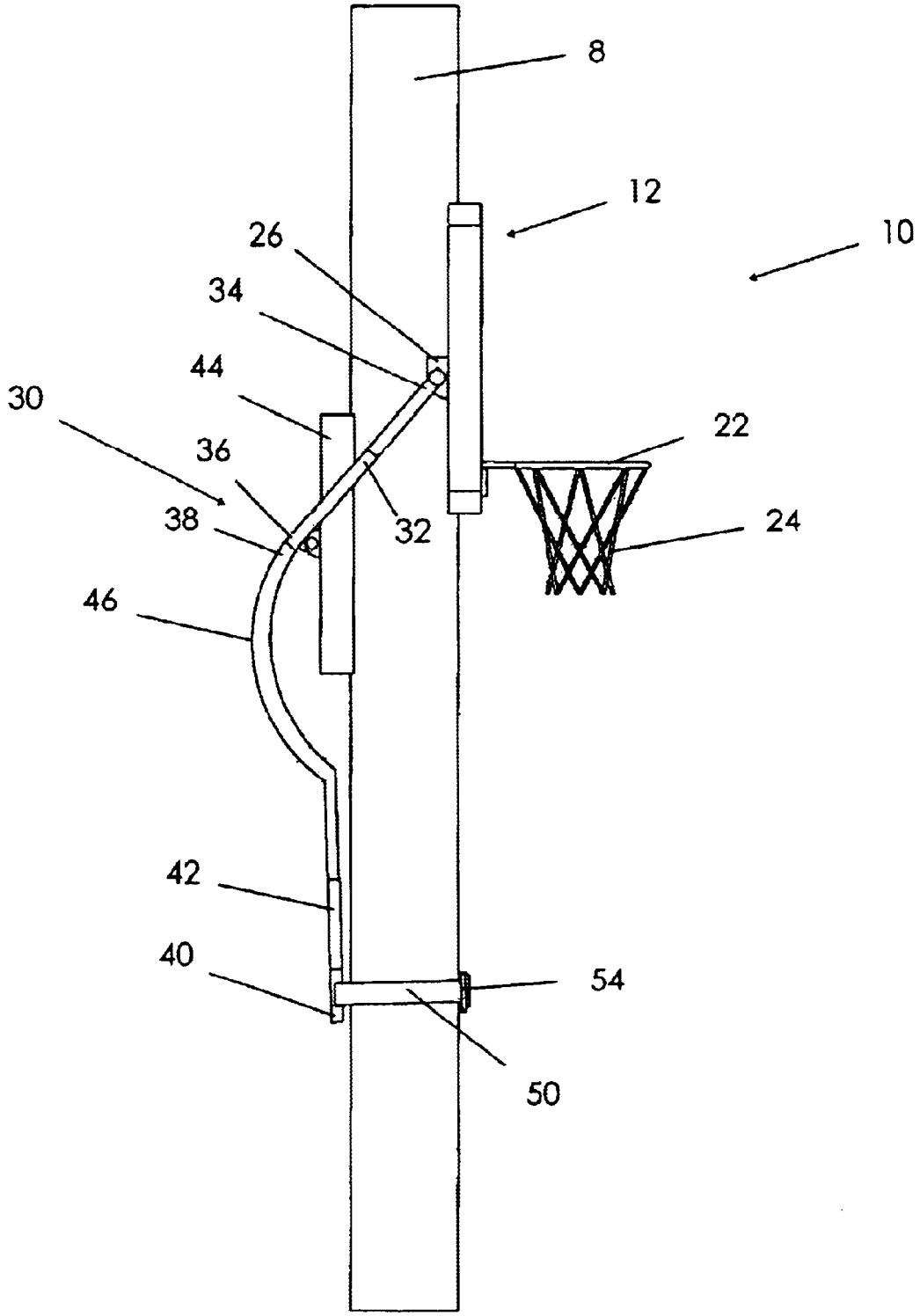
FIG. 3 is a side view of the apparatus as in FIG. 1 in a clamped configuration.
Figure 4:
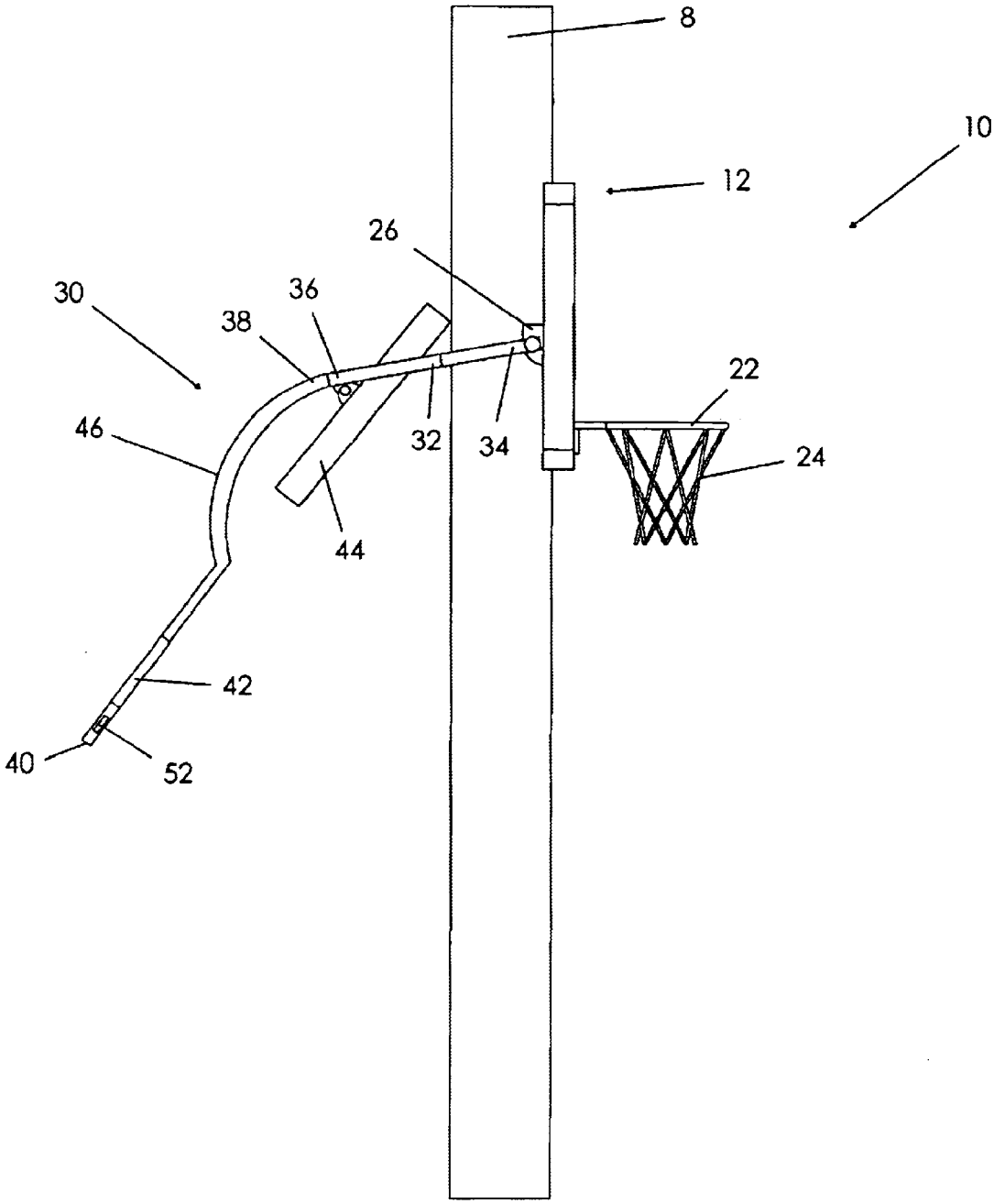
FIG. 4 is a side view of the apparatus as in FIG. 1 in a released configuration.

The clamping assembly further includes a rear support member 44 coupled to the upper end 38 of the lower portion of the clamping arm 30 generally at the point where the lower portion is connected to the divergent support braces 32 (FIG. 4). While the rear support member 44 may be fixedly attached to the clamping arm 30 at a configuration that allows it to bear against a rear surface of the upstanding structure 8 in a clamped configuration (FIG. 3), the rear support member 44 is preferably pivotally coupled thereto. The pivotal coupling establishes a horizontal axis that enables the rear support member 44 to pivot in relative forward and rearward directions relative to the backboard 12. Such movement is helpful during mounting or adjustment of the apparatus, particularly when mounting the apparatus 10 on structures having surface irregularities. An upper section 46 of the lower portion of the clamping arm includes a rearwardly arcuate configuration so as not to obstruct the rearward pivotal movement of a lower end of the rear support member 44 (FIGS. 3 and 4).

The rear support member 44 itself includes a generally rectangular configuration with a front surface thereof presenting a concave configuration (FIG. 1). This configuration enables the rear support member 44 to nest snuggly against a rear surface of the upstanding structure 8. Preferably, the rear support member 44 is constructed of a padded material so as to inhibit damage either to the upstanding structure 8 or to the clamping arm 30 in use. This material may be an elastomeric material such as synthetic rubber so as to present a gripping surface that inhibits slippage of the apparatus when clamped to a structure.

The clamping arm 30 may be releasably coupled to the upstanding structure 8 with a strap assembly. The strap assembly includes a single strap 50, such as a nylon strap, having a pair of strap ends, the strap 50 being releasably coupled to the lower end 40 of the lower portion of the clamping arm 30 by extending through a channel 52 defined by the lower portion (FIGS. 1 and 4). A ratchet assembly 54 is connected to one of the strap ends and is adapted to selectively receive the other strap end when the strap 50 is extended through the lower portion of the clamping arm 30 and wrapped about the upstanding structure 8. The ratchet assembly 54 may then be operated to selectively tighten the strap 50 about the upstanding structure 8, whereby to hold the clamping arm 30 in a clamped configuration (FIGS. 1–3). The use of a ratchet assembly allows much more force to be applied than is possible with a conventional pull-strap assembly. In the clamped configuration, the rear support member 44 and backboard 12 sandwich the upstanding structure 8 therebetween. It should be appreciated that the configuration of the clamping arm 30 provides weight-bearing support to the backboard 12 (FIG. 3). Obviously, the strap assembly may alternatively utilize a pair of straps coupled to the lower portion of the clamping arm 30 rather than a single strap extending therethrough.

In use, a user may select an appropriate upstanding structure 8, such as a utility pole, porch post, small tree, or the like. The backboard 12 and clamping arm 30 may be positioned in front of and to the rear of the upstanding structure 8, respectively, and be pivotally coupled together by coupling the free ends 34 of the support braces 32 to respective mounting brackets 26. The user may then grasp the handles 42 on the clamping arm 30 and raise the backboard 12 to a desired position along the upstanding structure 8, maintaining the clamping arm 30 somewhat displaced from the upstanding structure 8 so as to allow free movement of the backboard 12 (FIG. 4). In other words, the backboard 12 and rear support member 44 are kept in only loose contact with the upstanding structure 8 while positioning the backboard 12. This is the released configuration. Once the backboard 12 is at a desired position along the upstanding structure 8, a user may lower the lower portion of the clamping arm 30 to the clamped configuration (FIG. 3). More particularly, the lower end 40 of the lower portion of the clamping arm 30 is moved into contact with the upstanding structure 8. Here, the concave configurations of the backboard recess 18 and of the rear support member 44 enable a snug fit. In this configuration, the upstanding structure 8 is sandwiched between the backboard 12 and rear support member 44. The strap 50 may then be wrapped around the upstanding structure 8 and selectively tightened by manual operation of the ratchet assembly 54. This process may be reversed in order to further adjust the position of the backboard 12 or to completely remove and disassemble the apparatus 10.

Figure 5:
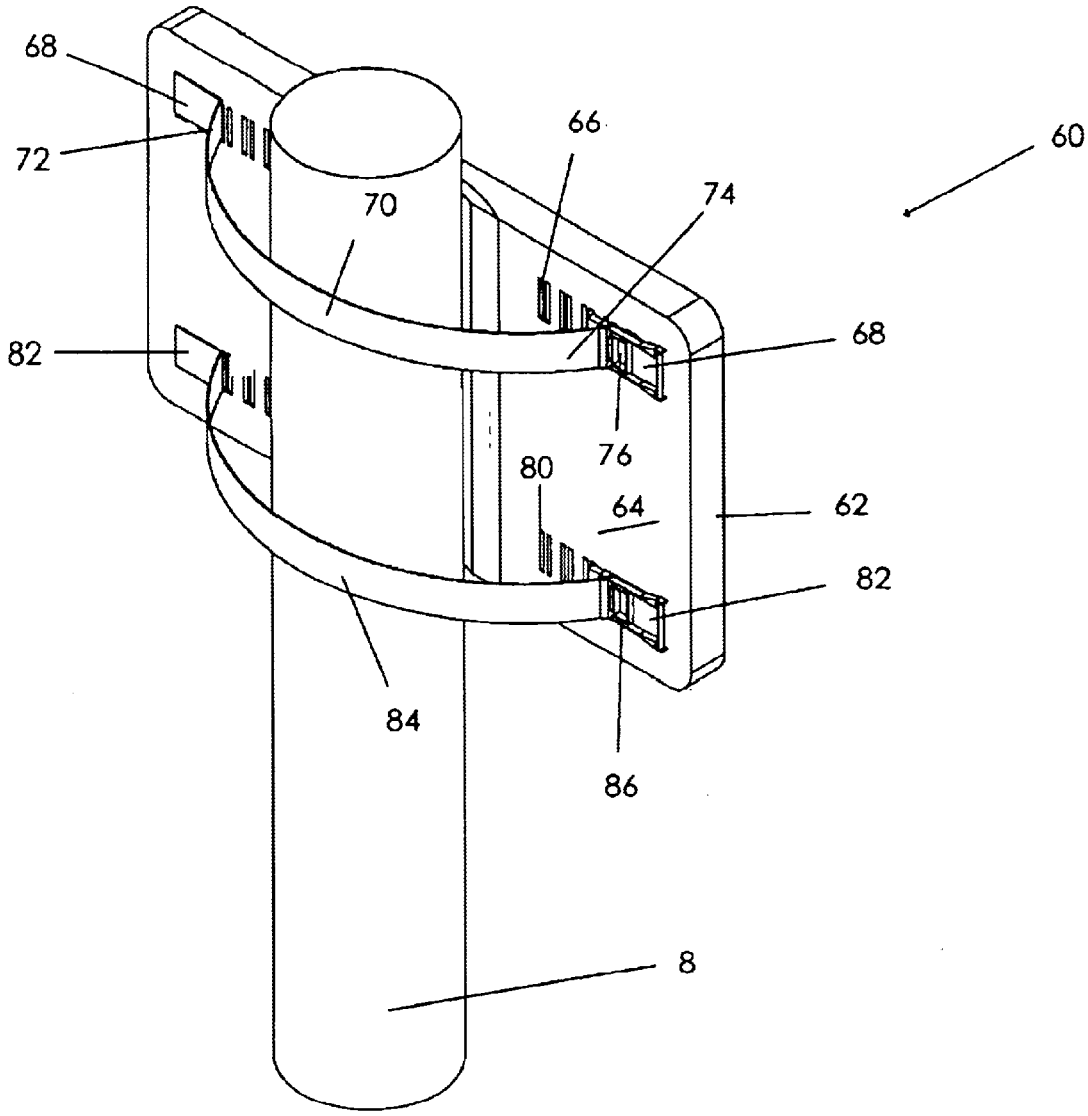
FIG. 5 is a rear perspective view of a basketball hoop apparatus according to another embodiment of the present invention mounted upon an upstanding structure of radius.

A basketball hoop apparatus 60 according to another embodiment of the present invention is shown in FIG. 5 and includes a construction that is substantially similar to that of the embodiment described previously except as noted below. The hoop apparatus 60 according to this embodiment includes a backboard 62. A back side 64 of the backboard 62 defines a first plurality of horizontally spaced apart slots 66 situated between opposed side edges of the backboard 62. This hoop apparatus 60 further includes a first pair of hook members 68, each having a configuration capable of engaging a selected one of the first plurality of slots 66. The apparatus 60 further includes a first strap 70 having a first end 72 fixedly attached to one of the first pair of hook members 68 and a second end 74. A first ratchet assembly 76 is fixedly attached to another of the first pair of hook members 68 and is adapted to selectively receive the second end 74 of the first strap 70 therein. Therefore, an operation of the first ratchet assembly 76 causes the first strap 70 to be tightened about the upstanding structure 8 when wrapped thereabout, thereby adjustably and portably attaching the backboard 62 to an upstanding structure of radius. The apparatus 60 further includes a second plurality of slots 80, a second pair of hook members 82, a second strap 84, and a second ratchet assembly 86, all being vertically spaced from and having constructions substantially similar to the constructions of corresponding elements described previously in this paragraph. It should be appreciated that the strap assemblies shown in FIG. 5 could also be utilized with the hoop apparatus first described above and shown in FIGS. 1–4 where greater stability in use is desired.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A portable and adjustable basketball hoop apparatus for attachment to an upstanding structure, said hoop apparatus comprising:

a backboard;

a rim connected to a front of said backboard;

an elongate clamping arm having a pair of spaced apart support braces pivotally coupled to a back of said backboard and having a free end opposed from said pair of support braces, said backboard and clamping arm being adapted to be positioned in front of and behind the upstanding structure, respectively, and said clamping arm being movable between a released configuration in which said backboard is movable longitudinally along the upstanding structure and a clamped configuration in which said backboard is attached to the upstanding structure;

means for releasably coupling said free end of said clamping arm to the upstanding structure; and wherein said clamping arm includes means situated between said support braces for bearing against a back of the upstanding structure when said clamping arm is at said clamped configuration.

2. The hoop apparatus as in claim 1 further comprising at least one handle member fixedly attached to said free end of said clamping arm, said at least one handle being adapted to be grasped by a person for moving said clamping arm between said released and clamped configurations.

3. The hoop apparatus as in claim 1 wherein said means for releasably coupling said clamping arm to the upstanding structure includes:

a strap coupled to said clamping arm having a pair of strap ends; and a ratchet assembly connected to one of said pair of strap ends and adapted to receive another of said pair of strap ends for incrementally tightening said strap about the upstanding structure.

4. The hoop apparatus as in claim 1 wherein:

said bearing means is a padded support member, a front surface of said padded support member having a concave configuration complementary to a configuration of a generally round upstanding structure; and said back of said backboard includes a padded portion having a concave configuration complementary to a configuration of a generally round upstanding structure.

5. The hoop apparatus as in claim 1 wherein said padded support member and said padded portion are constructed of rubber whereby to inhibit slippage of said padded support member and said backboard while in said clamped configuration and to enhance a friction fit relationship with the upstanding structure sandwiched therebetween.

6. The hoop apparatus as in claim 1 wherein said padded support member is pivotally coupled to said clamping arm and adapted to pivot in relative forward and rearward directions relative to said backboard, whereby to enable said backboard to be moved longitudinally along an upstanding structure having an irregular configuration.

7. The hoop apparatus as in claim 1 wherein said support braces are releasably coupled to said back of said backboard whereby said clamping arm may be selectively attached or detached from said backboard.

8. A portable and adjustable basketball hoop apparatus for attachment to an upstanding structure, said hoop apparatus comprising:

a backboard;

a rim connected to a front of said backboard;

a clamping assembly comprising:

an upper portion having a pair of divergent support braces pivotally coupled to a back of said backboard;

a lower portion having an upper end connected to said pair of divergent support braces and a lower end;

a rear support member connected to said upper end of said lower portion;

wherein said backboard and clamping assembly are adapted to surround the upstanding structure, said clamping assembly being movable between first and second configurations, said rear support member and said lower portion of said clamping assembly bearing against a back of the upstanding structure at said first configuration so as to sandwich the upstanding structure between said rear support member and said backboard, said lower portion being angularly displaced from the upstanding structure at said second configuration so as to enable said backboard to move longitudinally along the upstanding structure;

means for releasably coupling said lower portion of said clamping assembly to the upstanding structure when said lower portion is at said first configuration;

wherein said means for releasably coupling said lower portion of said clamping assembly to the upstanding structure includes:

a strap coupled to said clamping arm having a pair of strap ends; and a ratchet assembly connected to one of said pair of strap ends and adapted to receive another of said pair of strap ends for incrementally tightening said strap about the upstanding structure.

9. The hoop apparatus as in claim 8 wherein said pair of support braces are releasably coupled to said back of said backboard, whereby said clamping assembly may be selectively attached to or detached from said backboard.

10. The hoop apparatus as in claim 8 wherein:

said rear support member includes a front surface having a concave configuration adapted to nest snugly with a structure having a complementary configuration; and said back of said backboard defines a recess situated intermediate side edges thereof and extending longitudinally between top and bottom edges thereof, said recess having a concave configuration adapted to nest snugly with a structure having a complementary configuration.

11. The hoop apparatus as in claim 10 further comprising a layer of padded material situated within said recess, said layer of padded material and said rear support member being constructed of rubber.

12. The hoop apparatus as in claim 8 further comprising at least one handle member fixedly attached to said lower end of said lower portion of said clamping assembly, said at least one handle being adapted to be grasped by a person for moving said clamping assembly between said first and second configurations.

13. The hoop apparatus as in claim 8 wherein said rear support member is pivotally coupled to said upper end of said lower portion and establishes a horizontal axis about which said rear support member may pivot in relative forward and rearward directions.

14. The hoop apparatus as in claim 13 wherein said lower portion of said clamping assembly includes an upper section having a rearwardly arcuate configuration such that a lower portion of said rear support member may pivot rearwardly toward said lower portion of said clamping assembly.

* * * * *